United States Patent [19]

Thomas

[11] Patent Number: 4,653,645

[45] Date of Patent: Mar. 31, 1987

[54] TACO HOLDER AND SERVING ELEMENT COMBINATION

[76] Inventor: Bruce L. Thomas, 1279A Lea Ct. North, Smyrna, Ga. 30080

[21] Appl. No.: 811,138

[22] Filed: Dec. 19, 1985

[51] Int. Cl.[4] ..... B65D 85/36; B65D 1/36

[52] U.S. Cl. ..... 206/549; 206/557; 206/560; 206/564; 211/13; 211/60.1; 248/174; 426/119

[58] Field of Search ..... 206/549, 560, 564, 557, 206/443, 446; 426/119, 128; 211/13, 60.1; 229/DIG. 13; 220/23.4; D7/37, 72, 76, 70; 248/68.1, 174, 74.2; D6/536

[56] References Cited

U.S. PATENT DOCUMENTS

| | | | |
|---|---|---|---|
| D. 247,999 | 5/1978 | Whatley | D6/536 |
| D. 275,256 | 8/1984 | Gilliam | D7/76 |
| D. 278,199 | 4/1985 | Richards | D7/76 |
| D. 279,160 | 6/1985 | Hunt | D7/72 |
| 887,272 | 5/1908 | Robinson | 248/68.1 |
| 2,541,828 | 2/1951 | Peck | 206/480 |
| 2,850,182 | 9/1958 | Tetyak | 206/443 |
| 3,782,582 | 1/1974 | Lybbert et al. | 220/238 |
| 4,004,501 | 1/1977 | Guerrero | 220/23.8 |
| 4,055,670 | 10/1977 | Belmont | 426/119 |
| 4,270,660 | 6/1981 | Putt | D7/72 |
| 4,432,456 | 2/1984 | Ovadia et al. | 206/45.19 |
| 4,501,367 | 2/1985 | Potts | 211/13 |

FOREIGN PATENT DOCUMENTS

| | | | |
|---|---|---|---|
| 2013807 | 10/1980 | Fed. Rep. of Germany | 220/23.4 |
| 2432953 | 4/1980 | France | 206/446 |
| 2076784 | 12/1981 | United Kingdom | 206/45.14 |

*Primary Examiner*—William Price
*Assistant Examiner*—Brenda J. Ehrhardt
*Attorney, Agent, or Firm*—Henderson & Sturm

[57] ABSTRACT

This invention relates to an improved one-piece construction for taco shell holders, wherein, the holders are provided with a unique three legged support structure that allows the holders to be used in either a stand alone configuration or inserted into complementary recesses formed in a serving tray element specifically designed for use in combination with the taco holders.

7 Claims, 9 Drawing Figures

FIG. 1.
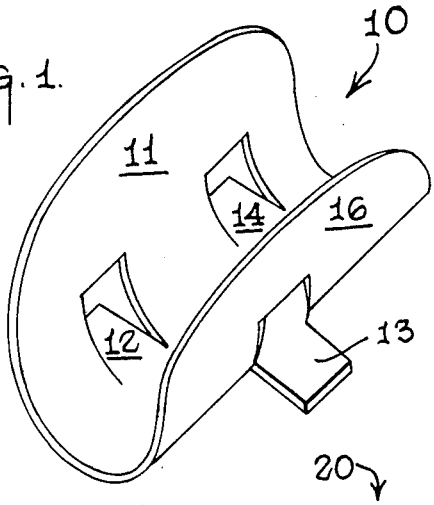
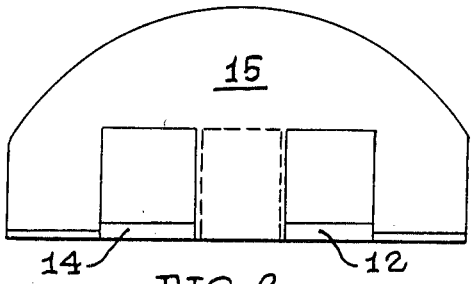
FIG. 2.
FIG. 3.
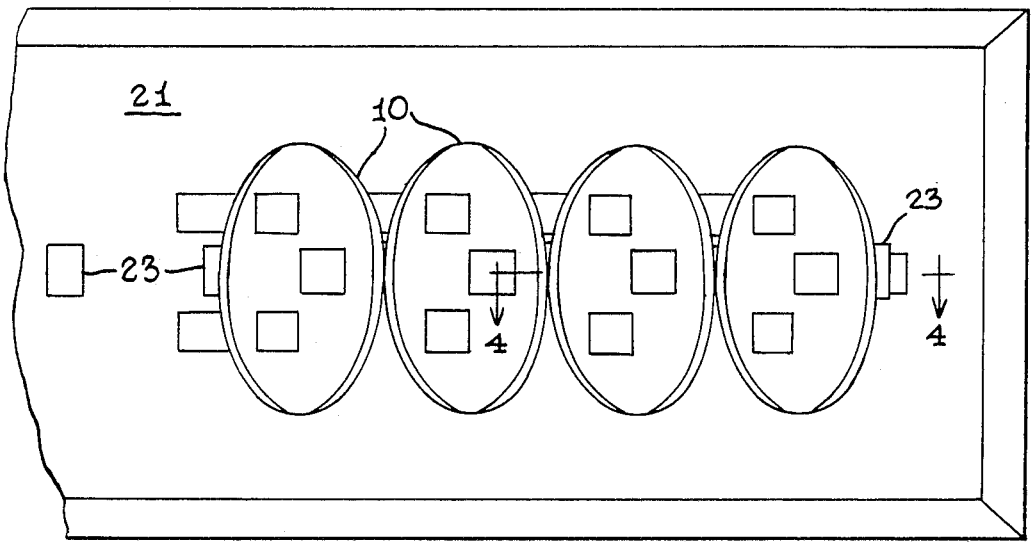
FIG. 4.
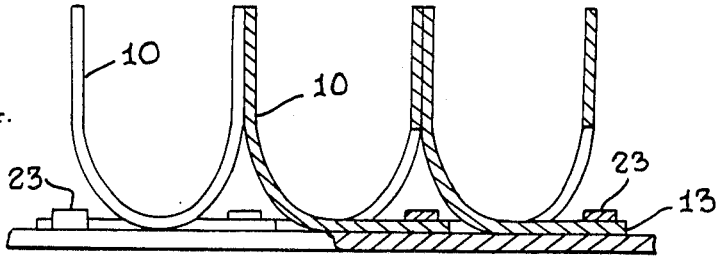
FIG. 5.
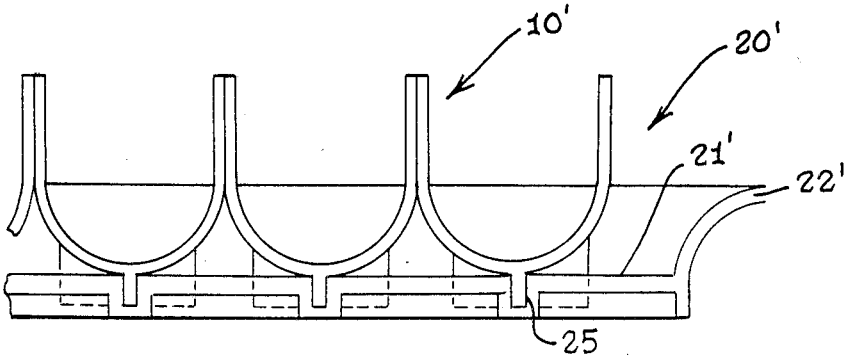

TACO HOLDER AND SERVING ELEMENT COMBINATION

BACKGROUND OF THE INVENTION

Anyone who is familiar with the preparation, serving, or consumption of the Mexican dish known as taco's, is aware of the difficulties encountered with depositing and retaining the various fillings, within the taco shell. These difficulties are directly attributable to the unique configuration of the taco shell itself, which normally lays on its side with or without a filling.

The traditional way of eating tacos has been to fill and consume individual taco's and then repeat the process. This manner of eating taco's has not presented a problem because it is a very simple matter for a person to maintain an individual taco shell, in an upright position during the relatively short period of time it takes to be consumed.

However, the American style of eating taco's, requires that a plurality of shells be filled, and then consumed on an individual basis. The problem then arises, as to how to maintain the remaining taco's in an upright position, so that the fillings will not spill out.

The various proposed solutions, that have been spawned by this problem, are represented in the following U.S. Pat. Nos: 4,004,501, and 3,782,582.

As can be seen by reference to these patents, while all of the prior art devices are adequate for their intended purpose, they do not provide the flexibility of accommodating single or multiple holders that will hold any one of a plurality of given number of taco shells. Stated in other terms, the previous holders are not expansible or contractible to only hold a chosen number of shells.

Up until the development of the present invention, a person either had to be satisfied with a plurality of noninteracting individual holders, or a multi-unit holder that would only accommodate a given number of shells. The present invention is designed to overcome the deficiencies found in the prior art, and combine the flexibility, expansibility, and interaction that the public has demanded.

SUMMARY 0F THE INVENTION

An object of the present invention is to provide a unique, single piece, stand alone, taco holder.

Another object of the present invention is to provide a stand alone taco holder, that is dimensioned to interact with identically dimensioned taco holders, to form a multi-unit taco holder.

Still another object of the present invention is to develop a taco holder, wherein, a plurality of support legs are formed from the wall portions forming the taco shell receptacle.

Yet another object of the present invention is to provide a taco holder that is simple and inexpensive to produce, and whose external appearance will not only be aesthetically pleasing, but functional as well.

A yet further object of the present invention is the provision of a taco holder, that will not only interact with similarly configured taco holders, but also with a specially designed serving support means, developed for that purpose.

A still further object of the present invention is the provision of a combined taco holder and serving support implement, that will overcome all of the problems associated with the prior art devices.

Yet another object of the present invention is to provide a three legged support for the taco holders that will allow them to be used in either a stand alone configuration, or in combination with a tray specifically designed to engage one or more of the three legs.

These and other objects, advantages and novel features of the invention will become apparent from the detailed description that follows, when considered in conjuction with the accompanying drawings.

BRIEF DESCRIPTION OF THE DRAWINGS

FIG. 1 is a perspective view of an alternate form of the preferred embodiment.

FIG. 2 is a side elevational view of this embodiment.

FIG. 3 is a top elevational view of the taco holder and associated tray element.

FIG. 4 is a cross-sectional view of the tray and holder taken through line 4—4 of FIG. 3.

FIG. 5 is a cross-sectional view of the preferred embodiment for the tray and holder.

DETAILED DESCRIPTION OF THE PREFERRED EMBODIMENT

Figure 6:
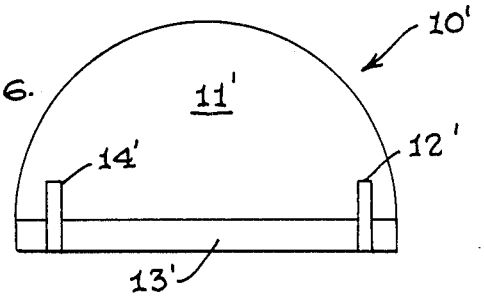
FIG. 6 is a front elevational view of the preferred embodiment for the taco holder.
Figure 7:
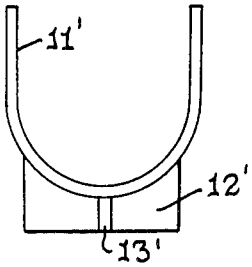
FIG. 7 is a side elevational view of this embodiment.

As can be seen by reference to the drawings, each of the two versions of the preferred embodiment that form the taco holders that comprise this invention are designated generally as 10. The particular material chosen for the fabrication of the holder 10 should possess the following traits, characteristics, or properties; inexpensive, readily available, each to work with, and subject to mass production techniques. In order of preference, the materials from which the preferred embodiment would be formed are: plastic; ceramics; metal; and reinforced cardboard. It should be noted that plastic is by far the superior choice for the following reasons: it is relatively rigid, durable, reusable, inert, washable, aesthetically pleasing, and inexpensive. The other choices of materials (e.g.—metal, cardboard) are by far the inferior choices, but they may be used to practice this invention. It should be noted at this point, that even though two versions of the preferred embodiment will be described and claimed, that the first version is in reality an alternate embodiment and the least desirable from a manufacturing standpoint.

Both of the embodiments that will be described will be fabricated preferably by an injection molding process; however, any suitable manufacturing process may be employed, and still keep within the teachings of this invention.

The first version of the preferred embodiment that will described, is illustrated in FIGS. 1 thru 4, and comprises a taco holder (10) and a serving tray element (20).

A.s can best be seen by reference to FIGS. 1 and 2 the taco holder (10) comprises an elongated generally U-shaped holder element (11) having three support legs (12), (13) and (14) projecting outwardly from the curved lower portion of the holder element (11).

While the width of each of the three support legs (12, 13 and 14) is virtually the same, two of the support legs (12) and (14) are substantially shorter than the third support leg (13) for reasons that will be explained presently. The two short support legs (12) and (14) are disposed on one side (15) of the holder element (11) and the longer support leg (13) is disposed on the opposite side (16).

The aforementioned disparity in length between the support legs serves several very important functions. The first of which is to give stability to the taco holder (10) when it is used in a stand alone configuration. The added length of the single support leg (13) provides added stability to the side of the holder element (11) that only has the single support leg. In addition since a plurality of individual taco holders (10) are intended to be frictionally engaged by the serving tray element (20), the added length of leg (13) will facilitate this engagement.

As can best be seen by reference to FIGS. 3 and 4 the serving tray element (20) comprises a generally flat rectangular tray member (21) having raised sides (22) and a plurality of spaced loop portions (23) formed in the tray bottom and running along its length. Each of the raised loop portions (23) is dimensioned to slidingly receive the elongated leg (13) of the individual taco holders (10), and maintain them in an aligned and side to side relationship.

The preferred embodiment as mentioned supra is illustrated in FIGS. 5 thru 9 and generally comprises a taco holder (10') and a serving tray element (20'). The taco holder (10') in this emboqiment comprises an elongated generally U-shaped holder element (11') having three downwardly depending support legs (12'), (13') and (14'). The support legs are generally rectangular in configuration and two of the support legs (12') and (14') are substantially shorter in length than the third support leg (13').

Figure 9:
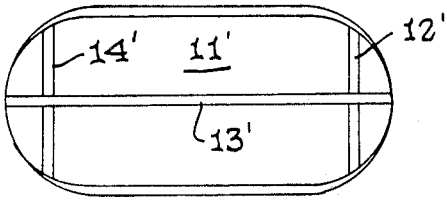
FIG. 9 is a bottom elevational view of the taco holder of the preferred embodiment.

As can best be seen by reference to FIG. 9, the elongated support leg (13') runs along the length of the taco holder body (11'), and the shorter support legs (12') and (14') are disposed across the width of the body (11') proximate the ends. The relative dimensions of the three support legs provides a very stable base that will allow the taco holder 10' to easily be deployed in a stand alone configuration.

Figure 8:
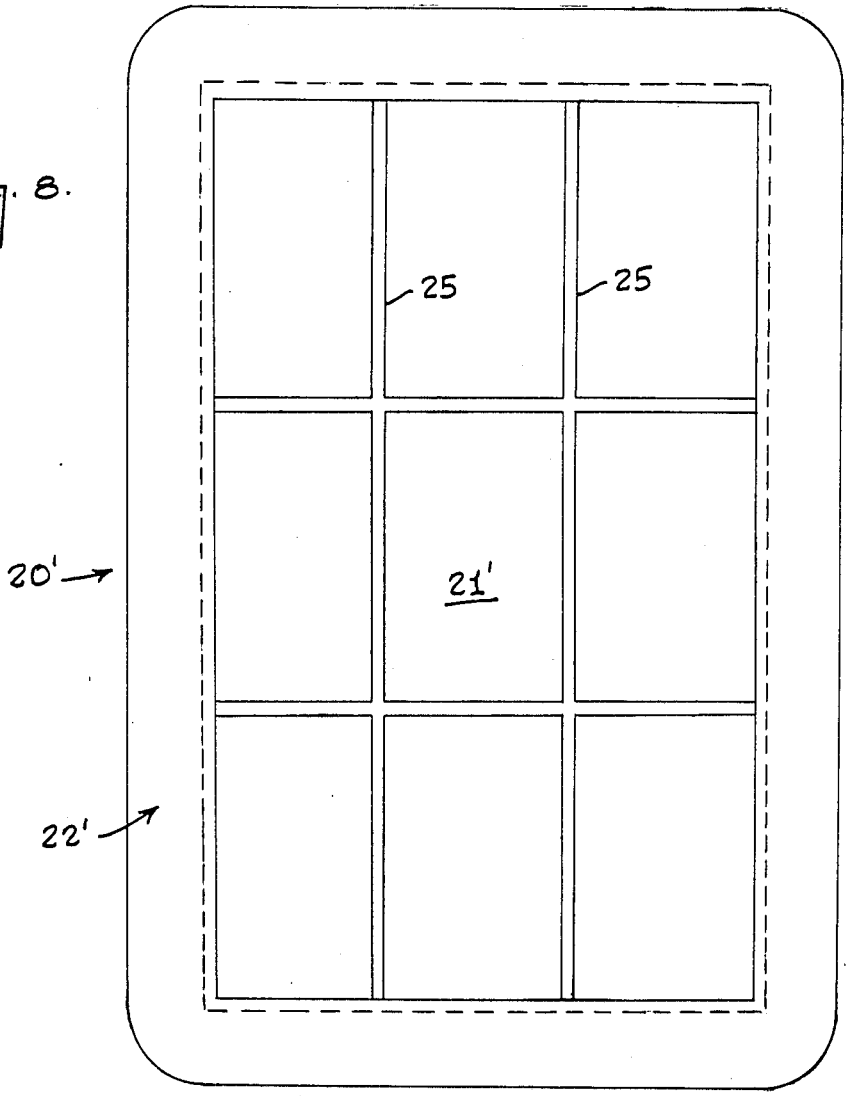
FIG. 8 is a top elevational view of the tray employed in the preferred embodiment.

The serving tray element (20') is best depicted in FIGS. 5 and 8 and comprises a genrally flat rectangular tray member (21') having raised sides (22') and a plurality of recesses (25) formed in the tray bottom. The recesses (25) are disposed across the length and width of the tray bottom, and are dimensioned to frictionally engage the legs of the individual taco holders (10) and maintain them in an aligned and side to side relationship.

It should be appreciated at this point, that a taco holder and serving tray element built in accordance with the teachings contained in this specification will produce an extremely convenient combination wherein the tacos can be filled and transported to a table and then consumed while the taco holders are still retained in the serving tray element; or the holders can be physically removed from the serving tray and used in their stand alone configuration.

Having thereby described the subject matter of the invention, it should be obvious that many substitutions, modifications and alterations are possible in light of the above teachings. It is therefore to be understood that the invention as taught and described is only to be limited to the extent of the breadth and scope of the appended claims.

What I claim is:

1. An improved taco holder comprising:

an elongated generally U-shaped holder element dimensioned to form a receptacle for a taco, and having three legs that maintain the holder element in a stand alone configuratin; wherein:

one of the said three legs is substantially longer than the other two legs;

two of the said three legs are oriented in one direction with respect to the holder element, and the other leg is oriented in a different direction with respect to the holder element;

the leg that is substantially longer than the other two legs is oriented in a different direction than the other two legs with respect to the holder element; and, all of the said legs project outwardly from the bottom of the U-shaped holder element in the general plane.

2. An improved taco holder as in claim 1; wherein, all of said legs project outwardly from the bottom of the U-shaped holder element in the horizontal plane.

3. An improved taco holder as in claim 1; wherein, all of said legs project outwardly form the bottom of the U-shaped holder element element in the vertical plane.

4. An improve taco holder as in claim 2; wherein, the said legs are formed from the receptacle walls of the U-shaped holder element.

5. An improved taco holder as in claim 2; wherein, the said one direction and the said different direction are opposite from one another.

6. An improved taco holder as in claim 3; wherein, the said one direction and the said different direction are perpendicular to one another.

7. An improved taco holder and serving tray element used in combination with one an other and comprising:

an improved taco holder consisting of:

an elongated generally U-shaped holder element having three legs; wherein, one of the said three legs is substantially longer than the other two legs;

two of the said three legs are oriented in one direction with respect to the holder element, and the other leg is oriented in a different directin with respect to the holder element;

the leg that is substantially longer than the other two legs is oriented in a different direction than the other two legs with respect to the holder element; and, the said three legs project outwardly from the bottom of the U-shaped holder element; and a serving tray element comprising a generally flat elongated serving tray having portions that will firctionally engage at least one of said three legs of the holder element, so that additional holder elements can be inserted into the tray in an aligned and side by side relationship.

* * * * *